US007544124B2

(12) United States Patent
Polston

(10) Patent No.: US 7,544,124 B2
(45) Date of Patent: Jun. 9, 2009

(54) ATTIC VENT

(75) Inventor: Scott Polston, 8111 Bairnsdale, Houston, TX (US) 77070

(73) Assignee: Scott Polston, Houston, TX (US)

( * ) Notice: Subject to any disclaimer, the term of this patent is extended or adjusted under 35 U.S.C. 154(b) by 202 days.

(21) Appl. No.: 11/306,276

(22) Filed: Dec. 21, 2005

(65) Prior Publication Data

US 2007/0141975 A1 Jun. 21, 2007

(51) Int. Cl.
*F24F 7/02* (2006.01)
*F24F 13/08* (2006.01)
*F24F 13/20* (2006.01)

(52) U.S. Cl. ..... 454/367; 454/366; 454/368; 52/198; 52/199

(58) Field of Classification Search ..... 454/356, 454/365, 366, 367, 368; 52/198, 199
See application file for complete search history.

(56) References Cited

U.S. PATENT DOCUMENTS 1,983,979 A * 12/1934 Graham ..... 454/117
2,163,077 A * 6/1939 Wilson ..... 454/37
2,279,016 A * 4/1942 Silver ..... 454/19
2,628,551 A * 2/1953 Leigh ..... 454/366
2,826,136 A * 3/1958 Smith ..... 454/368
3,094,915 A * 6/1963 Leigh ..... 454/366
3,183,822 A * 5/1965 Stone et al. ..... 454/38
3,502,016 A * 3/1970 Steele ..... 454/306
3,654,850 A * 4/1972 Berkus ..... 454/367
4,189,989 A * 2/1980 Maze ..... 454/38
4,297,818 A * 11/1981 Anderson ..... 52/199
4,759,270 A 7/1988 Lindeen
5,005,328 A * 4/1991 Holtgreve ..... 52/199
5,402,611 A * 4/1995 Vagedes ..... 52/198
5,588,908 A * 12/1996 Camarota ..... 454/78
5,591,080 A 1/1997 Ward
6,155,008 A 12/2000 McKee
6,520,852 B2 2/2003 McKee et al.
6,612,924 B1 9/2003 Mantyla et al.
6,733,381 B1 5/2004 Ploeger
6,767,281 B2 7/2004 McKee
6,954,947 B1 10/2005 Williams, Jr.

* cited by examiner

*Primary Examiner*—Steven B McAllister
*Assistant Examiner*—Patrick F. O'Reilly, III
(74) *Attorney, Agent, or Firm*—Jack A. Kanz

(57) ABSTRACT

A passive venting device for venting enclosures comprising a base member, an intermediate splash member including a diverter, and a top, dome-shaped member. In a preferred embodiment, the diverter may be molded as a single unit of manufacture with the base member. The venting device allows air and other gases to escape from within an enclosure to be vented while preventing the incursion of moisture in the form or rain or snow into the enclosure.

7 Claims, 5 Drawing Sheets

ATTIC VENT

FIELD OF THE INVENTION

This invention relates generally to the field of venting devices, and in particular, to a passive vent for mounting on the slanted roof of a residential dwelling or the like. The vent may as easily be mounted onto a flat roof, as desired.

BACKGROUND OF THE INVENTION

As described in U.S. Pat. No. 6,767,281 to McKee (McKee '281), most buildings and enclosures where human activity takes place require some type of venting. The type of venting device used depends on the kind of enclosure to be vented. For example, bathrooms with showers typically have active vents with fans to vent steam to the outdoors. Kitchens, particularly in restaurants and hotels, similarly have powered vents for removing smoke, steam, and other matter in the air to the outdoors.

Other types of enclosures, such as attics, do not require active venting. However, such enclosures do typically require a passive vent to allow for air flow from the enclosure to the atmosphere. This type of venting prevents a buildup of moisture in the enclosure and reduces the heat trapped in the attic space. The venting of attic spaces by this method is required by the building codes of many jurisdictions.

As used herein, the term "passive" as applied to a vent means that the vent does not include a mechanism for forcing air out of the enclosure. Rather, the vent simply includes an air conduit which allows air flow. Passive vents are well-known and have been extensively used in the past, including that disclosed by McKee. Although often formed of metal, good results have been achieved more recently with plastic vents, including passive vents.

House attics and other similar enclosures are sometimes vented simply by one or more passive venting devices on the roof. The passive venting devices are each positioned above a ventilation passage in the roof which permits air to flow from the enclosure to the outside.

In other cases, a more sophisticated venting system is used. Such a system includes intakes for bringing air into the enclosure, operating together with vents permitting air to flow out of the enclosure. Ideally, such a system causes outside air to flow through the enclosure. In this way, gases and vapors in the enclosure, including water vapor, are carried out of the enclosure by the air flow through the vents. Moisture and temperature are thus equalized between the enclosure and the outside.

For example, on sloped roofs, it is common to have intakes installed beneath the eaves for bringing air into the attic. Vents for venting air out of the attic are installed higher up on the roof, near the peak. Thus, warm moist air within the enclosure rises and flows out through the vents. Air from the outside is taken into the enclosure through the intakes because of the pressure differential created by the outflow of air through the vents.

Part of the function of a vent is to allow the flow of air through the passage, without permitting moisture, such as rain or snow, to enter the enclosure through the passage. Thus, prior art vents have included features to prevent such entry of moisture.

For example, U.S. Pat. No. 6,155,008 to McKee (McKee '088) discloses a passive venting device for venting a building enclosure. The device includes a base member having a vent structure therein. The vent structure is to be positioned over the ventilation passage which extends through the roof of the enclosure. The device also includes a cap member which is positioned over the vent structure to prevent rain and snow from falling directly into the vent structure and through the passage. The cap member, however, is spaced apart from the base to allow air to flow between the cap and the base and through the vent structure.

It has been found that, despite the presence of a cap over the vent structure in devices such as the McKee device, precipitation, such as snow, can occasionally pass into the enclosure through the vent structure. This is because, with the McKee device, snow accumulates at the base of the device, near the bottom edge of the cap. Experience has shown that wind traveling along the sloped roof will often drive the snow up under the cap and through the vent structure into the attic.

This problem can be exacerbated in cases where the intakes beneath the eaves become blocked, are improperly installed, do not exist, or have inadequate openings for the free flow of air into the ventilated space. In such cases, the vent on top of the roof, rather than the eave intakes, can act as an intake vent. For example, where there is no air inflow from the eaves, when air flows out of one vent, it must flow in through another vent. Or, air may flow out through one region of the vent structure of a vent while flowing in through another region of the vent structure. Either way, if any air flows into the vent, snow or rain near the vent can be drawn into the enclosure. Any snow blown toward the vent structure will be more likely to enter if the air flow passes into the vent.

It has also been found that, though devices such as the McKee device are generally effective in blocking the entry of rain into the attic, they can leak during extreme weather conditions such as torrential rain. There are at least two reasons for this. First, torrential rains are often accompanied by high winds, which can drive rain drops into the vent structure in the same way described above with respect to snow. Second, because there is a great deal of rain falling very hard, rain drops can strike the device, bounce up under the cap, and enter the vent structure. As with snow, more rain will enter the attic in cases where the device is acting as a full or partial intake.

Another issue with respect to roof vents is their use in conjunction with roofing materials such as shingles, shakes or tiles. The venting device disclosed in McKee includes a wide nailing flange which is nailed to the roof to permit shingles to be lapped over the flange. Thus, on a sloped shingled roof, shingles are installed on top of the flange on the top end and side ends of the flange. At the bottom, the flange overlaps the shingles. In this manner water is shed off the roof.

To provide an appropriate seal for the roof, shingles are typically lapped over the flange right up to the vent structure in the centre of the device. One reason that this is done is to reduce the probability that water will enter under the sides of the shingles.

Unfortunately, McKee '008 and '281 include a ventilation pathway that is opening vertically to the sky. This means that precipitation falling onto the top of the vent structure may be directed straight down into the ventilation pathway and into the vent structure. Also, the vent structure of McKee includes areas below the vent structure which tend to trap moisture, thus creating a pool which may encourage mildew or other unwanted growth of matter.

Thus, there remains a need for an attic vent structure which more effectively restricts the inflow of moisture into the volume which is to be vented. The present invention solves this and other problems in the art.

SUMMARY OF THE INVENTION

The present invention addresses these and other needs and drawbacks in the art by providing a passive vent. The vent includes a base member with a large, flat mounting surface which fits over an opening in a roof into a volume which is to be vented to the atmosphere. The base member includes a plurality of post receiving openings to receive securing posts which are integrally formed on a dome-shaped top member. In between the base member and the top member is a splash plate member, which may also be referred to herein as a diverter plate or member. In a presently preferred embodiment, the diverter plate may be included as a separate piece to be assembled into the vent, or it may preferably be molded as a unit of manufacture with the base member.

The splash plate (i.e. the diverter) member includes a plurality of grooves to fit around the securing posts of the dome-shaped top member. The diverter effectively stops rain or snow from being drawn or splashed into the volume to be vented. As previously described, the diverter may also be built into the base mold in a unitary or one-piece system as opposed to a device that slips over the base.

These and other features and advantages will be readily apparent to those of skill in the art from a review of the following detailed description along with the accompanying drawing figures.

DETAILED DESCRIPTION OF A PREFERRED EMBODIMENT

Figure 1:
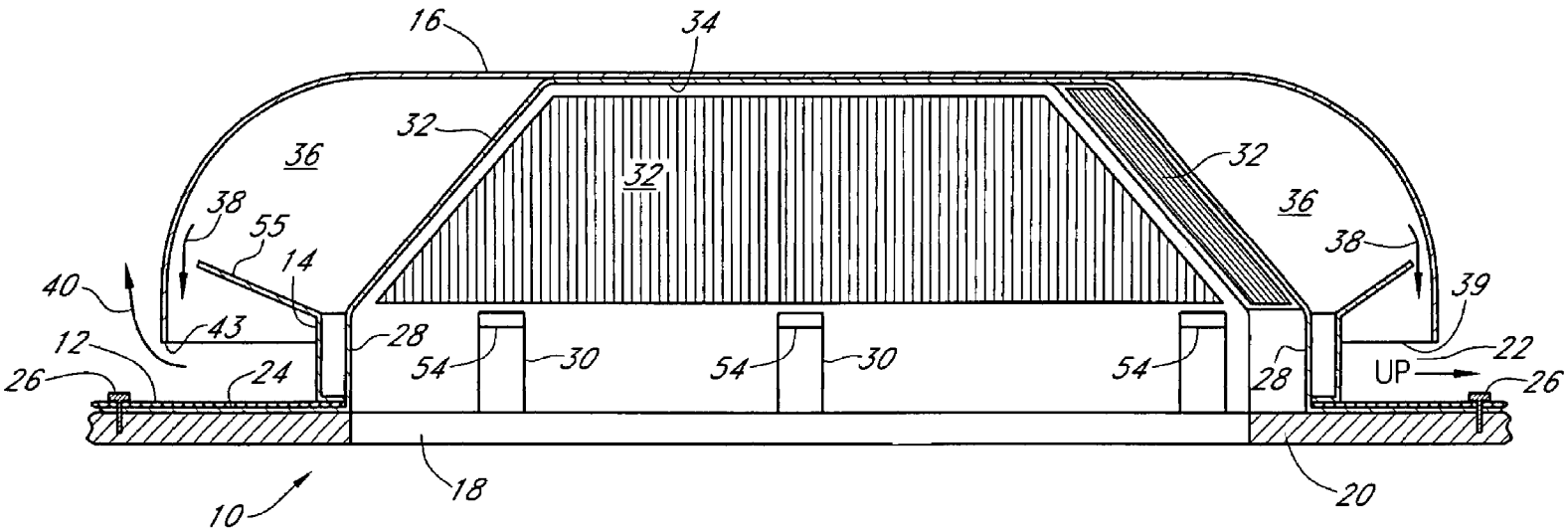
FIG. 1 is a side section view of the passive vent of the present invention assembled into a functional unit.
Figure 2:
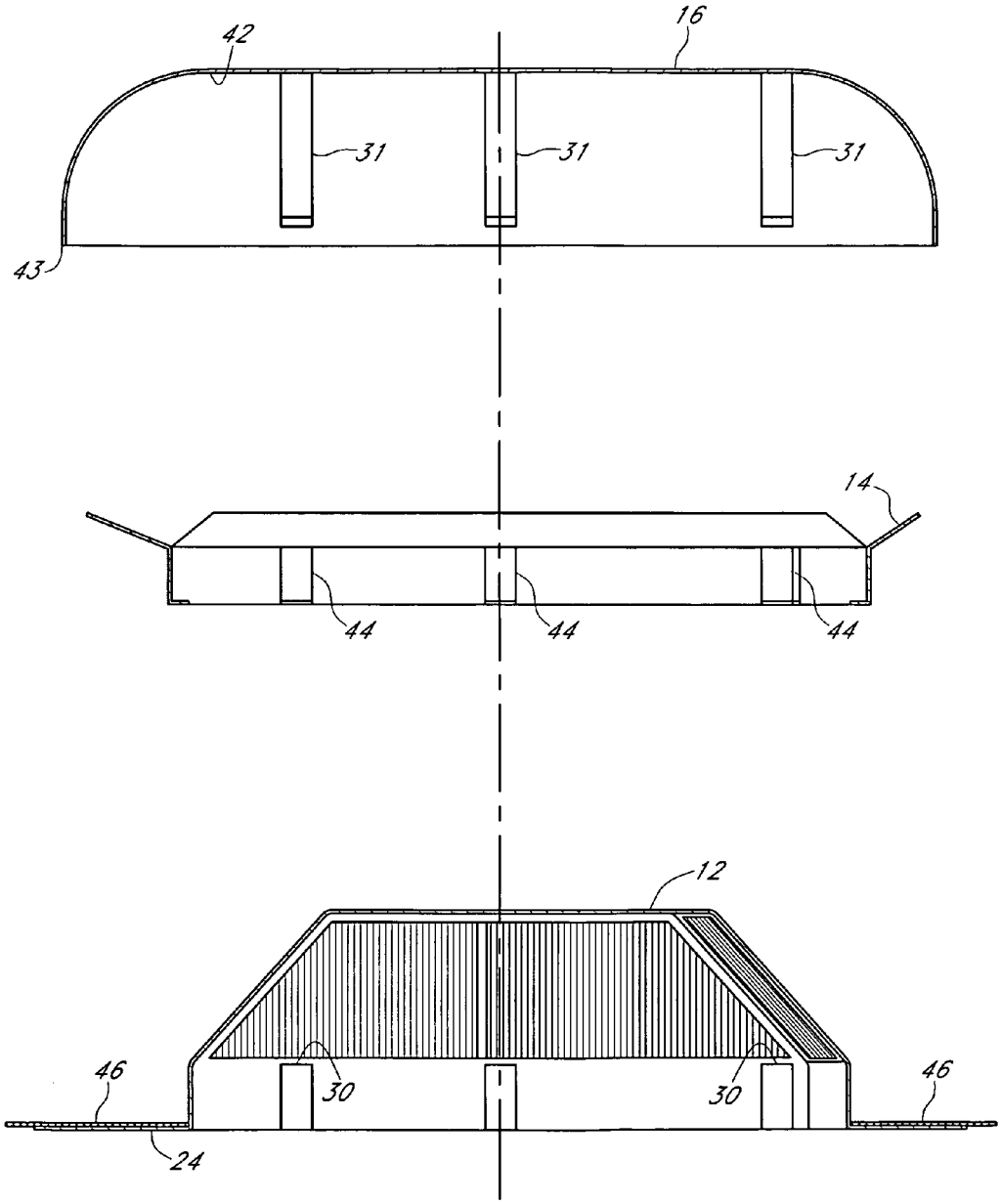
FIG. 2 is a side exploded section of the vent to illustrate the three main components of the invention.

Referring first to FIGS. 1 and 2, there is shown a section view of the passive vent 10 of this invention in an assembled condition (FIG. 1) and in an exploded view (FIG. 2). The vent 10 comprises primarily a bottom base component 12, an intermediate diverter component 14, and a top, dome-shaped component 16. The entire vent, once installed, fits in a water-tight seal over an opening 18 in a roof 20, such as for example over an attic or other similar enclosure which requires venting. If the vent 10 is installed on a sloping roof, such as is common on a residence, then the vent 10 includes a preferred orientation so that a particular portion of the vent is directed up the slope of the roof, as indicated by a legend marker 22, which is preferably molded into the base component 12 to assist an installer in properly orienting the vent 10.

The base component 12 includes a wide, flat mounting plate or flange 24. The mounting plate 24 extends beyond the dome-shaped component 16 so that mounting nails 26 may more easily be installed. The mounting plate 24 is integrally formed with a vertical wall 28, which in a preferred embodiment is a 5-sided wall, as shown and described below. The vertical wall 28 has molded therein a plurality of post receiving openings 30. Each of the openings 30 defines a right rectangular cylinder, which receives a post 31 from the dome-shaped component, as shown and described below.

Extending from the upper rim of the vertical wall 28 is an open grill 32 in fluid communication with the vent opening 18. The underside of the grill 32 is exposed directly to the volume being vented, such as an attic. Preferably, the total cross sectional area for air flow through the grill 32, and any other vents 10 installed on the building, approximately equals the vent openings under the eaves of the building being vented for proper ventilation of the attic space and so that the pressure inside the attic is equal to outside barometric pressure. Finally, the base component 12 includes a top 34, which is preferably in abutting contact with the underside of the dome-shaped component 16. The top 34 preferably includes just enough material to maintain structural robustness of the structure, but does not contribute vent openings for ventilation of the space.

Air or gases which are to be vented from the enclosure below the vent 10 flow out through the opening 18 and through the grill 32 into a volume 36 between the bottom, base component 12 and the dome-shaped component 16. The air then flows downward, as shown by an arrow 38 around the edge of the baffle component 14 then out into the atmosphere, as shown by an arrow 40. Thus, for any moisture, such as rain or snow, to get into the vented space, it must follow the reverse of the circuitous route just described for the venting of gas, and entry of moisture is effectively eliminated. Further, an opening 39 from the space to be vented is directed downward, toward the base element 12, for the venting of gas and moisture from the vent opening 18. Thus, the top, dome-shaped component 16 defines a bottom edge 43 around which vented air passes.

Focusing now more particularly on FIG. 2, there is shown an exploded view of the vent 10 of this invention. As previously described, the top, dome-shaped component 16 includes a plurality of downwardly extending posts 31, extending from beneath a bottom surface 42 of the component 16. Preferably, six such posts are included, although more or fewer may be included. The posts are preferably arrayed in two rows of three such posts, although any number may be used. The posts are preferably molded with the component 16 although they may be otherwise affixed to the component 16. The posts slide down through open grooves 44 in the intermediate component 14 and then into the post receiving openings 30. Preferably, the posts include an outwardly extending ratchet flange to snap fit into the openings 30 to securely retain the entire structure together.

FIG. 2 also shows a composite roofing shingle 46 placed over the mounting flange 24. Once the bottom component 12 has been installed onto a roof, positioned over a vent opening 18 in the roof (see FIG. 1), then roof shingles may be installed over the mounting flange to form a water tight seal to prevent the intrusion of water beneath the shingles and onto the roof.

Figure 3:
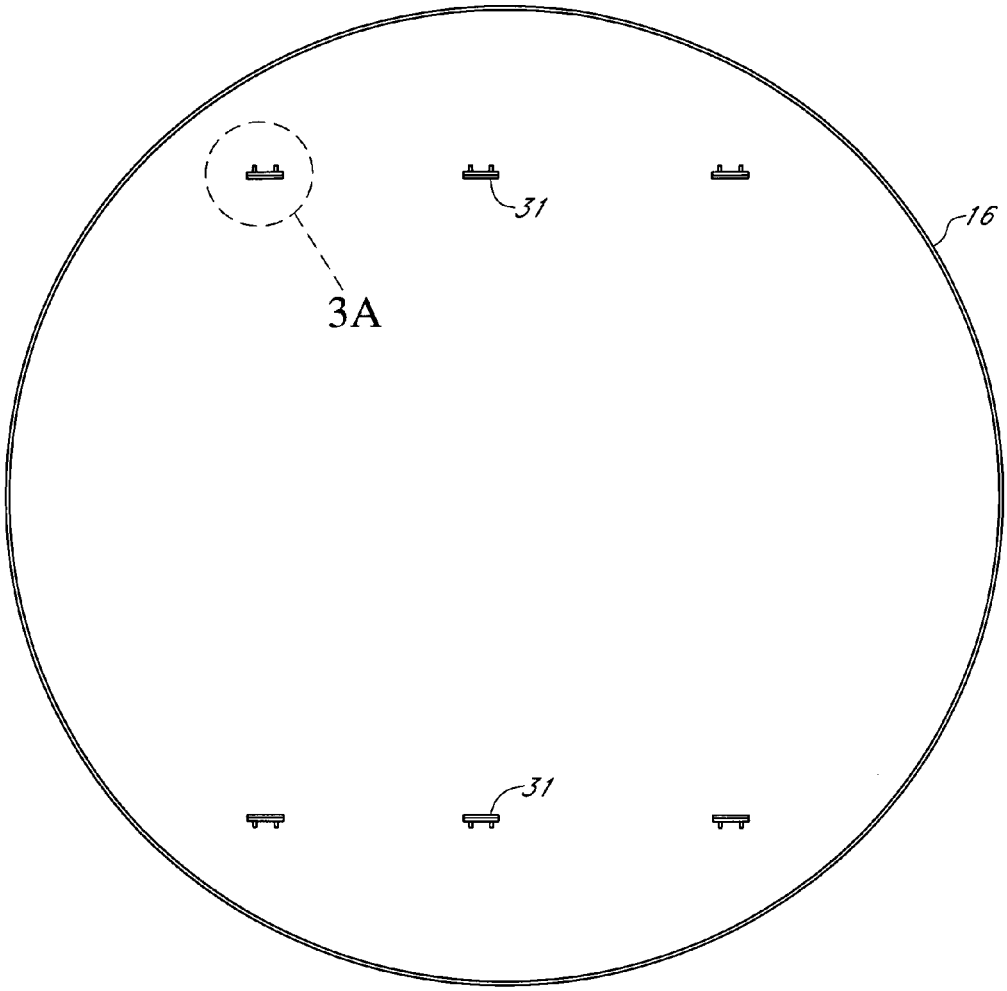
FIG. 3 is a bottom view of the dome element of the vent.
Figure 3A:
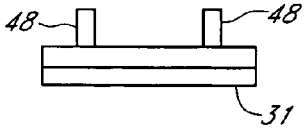
FIGS. 3A and 3B are detail views of a snap-fit post which is formed as an integral part of the dome of FIG. 3.
Figure 3B:
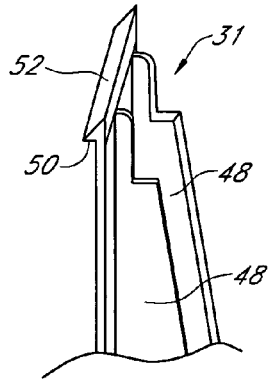

FIGS. 3, 3A, and 3B depict a presently preferred embodiment of the top, dome-shaped component 16. These figures are provided to show and describe in greater detail the preferred structure for securing the three main components together, although those of skill in the art will recognize that this is just one of many ways to accomplish this function.

Formed as by molding on the underside of the component 16 are several posts 31. The posts 31 are arranged in two rows of three posts. The posts may be oriented uniformly in the rows so that one may install the dome aligned with the post receiving openings 30 without regard as to whether the dome should be oriented up-slope or down-slope on the roof. Each post preferably includes a pair of ribs 48 to provide rigidity to the post with a minimum amount of material. As shown in FIG. 3B, the post 31 includes a ratchet flange 50 extending from a tapered end 52. The tapered end helps in guiding the post into the opening 30, and the flange 50 mates with a corresponding shelf 54 (see FIG. 1) to firmly hold the dome 16 in place.

Figure 4:
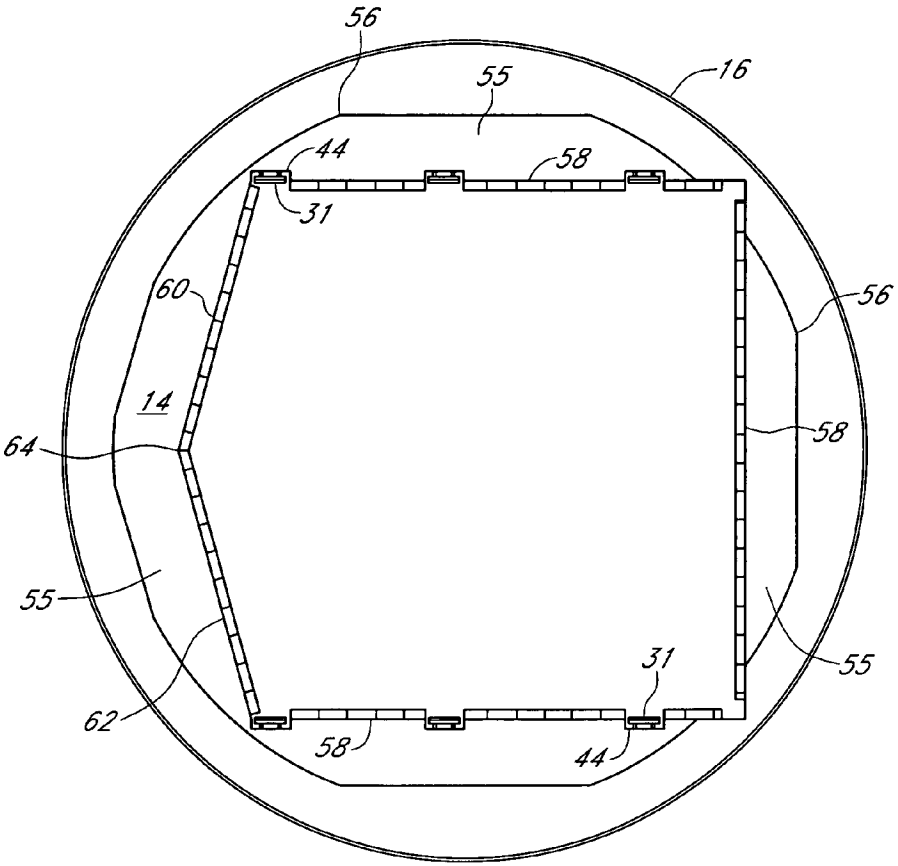
FIG. 4 is a bottom view of an intermediate splash or water diverter plate element of the vent.
Figure 5:
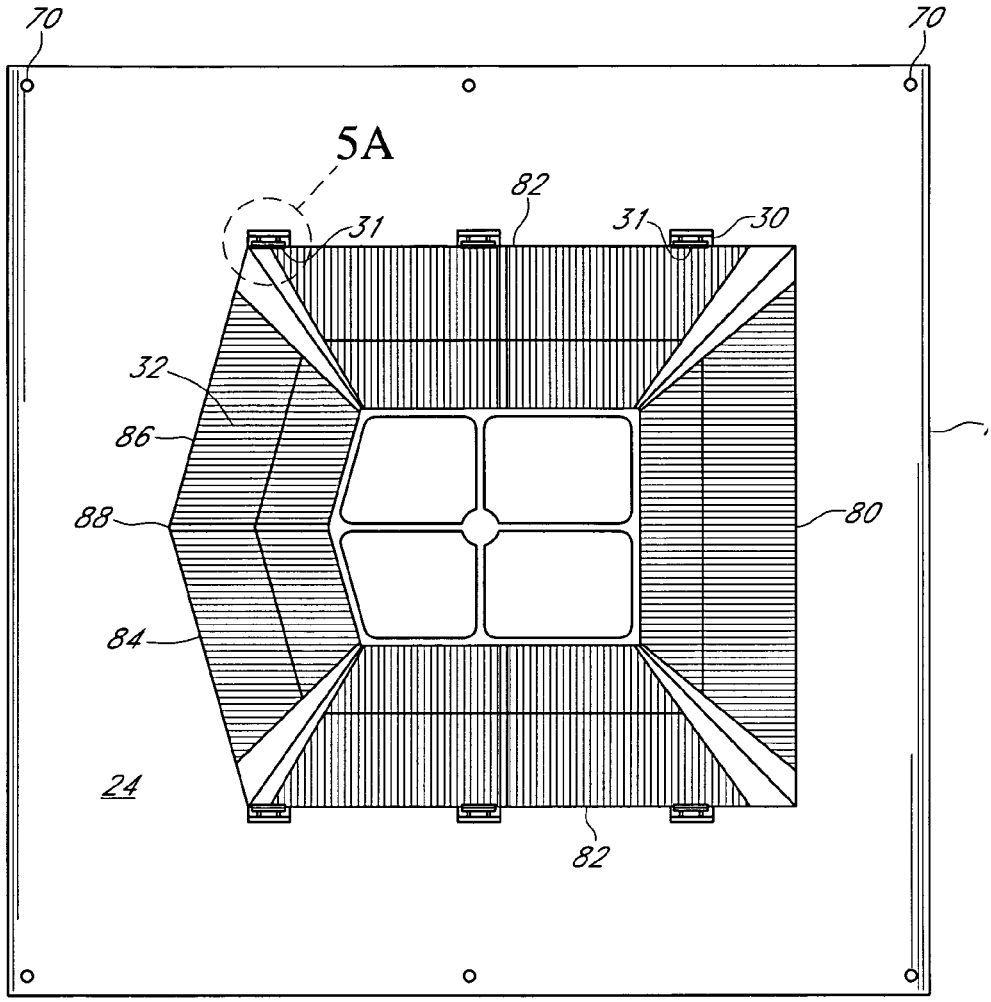
FIG. 5 is a top view of the bottom, base element of the vent.
Figure 5A:
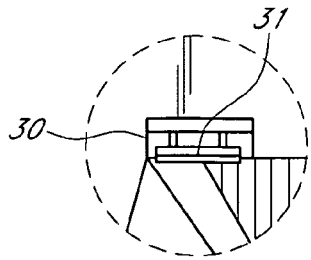
FIG. 5A is a detail view of the bottom, base element depicting the mating components of the post of FIG. 3A and the female, receiving ports of the base element.

FIGS. 4 and 5 illustrate another feature of the present invention, wherein the up-slope portion of the intermediate component and the base component must be properly oriented. FIG. 4 shows the underside of the intermediate component 14 joined to the upper, dome-shaped component 16. FIG. 5 depicts a top view of the bottom, base element of the vent.

Referring first to FIG. 4, the posts 31 (molded with and extending downwardly from the top dome component 16) slide through open grooves 44 formed in the intermediate component 14. The component 14 includes an upwardly and outwardly angled diverter 55 around the periphery of the component 14. As illustrated in FIG. 1 the diverter 55 is supported on a vertical wall of the component 14 which at least partially surrounds and is spaced from vertical wall 28 of the base component 12 so that the diverter 55 extends upwardly and outwardly from the vertical wall 28 and into the air flow space between the top dome and vertical wall 28. The diverter 55 contacts the underside of the dome at points 56 of the diverter 55 but otherwise provides a space for the flow of air as shown by the arrow 38 of FIG. 1.

Note particularly the component 14 defines three, perpendicular sides 58 but a fourth side of the component 14 defines a side 60 and a side 62, which meet at a point 64. The point 64 is oriented up-slope so that rain water easily flows around the vent 10. Similarly, as shown in FIG. 5, the base component 12 includes a substantially flat, laterally extending mounting flange 24 (see also FIG. 2). A first vertically extending wall 80 is oriented down-slope and is perpendicular to the flange 24 and a pair of vertically extending walls 82. Finally, a pair of walls 84 and 86 are positioned on the up-slope portion of the vent, and meet at a point 88. This way, as rain water flows down a roof, if encounters the point 88 and is diverted to either side along the walls 84 and 86 without substantial resistance to flow.

The posts 31 snap into corresponding parts of the base component 12 to hold the vent 10 together. The base component 12 may include a plurality of nail holes 70, if desired.

Figure 6:
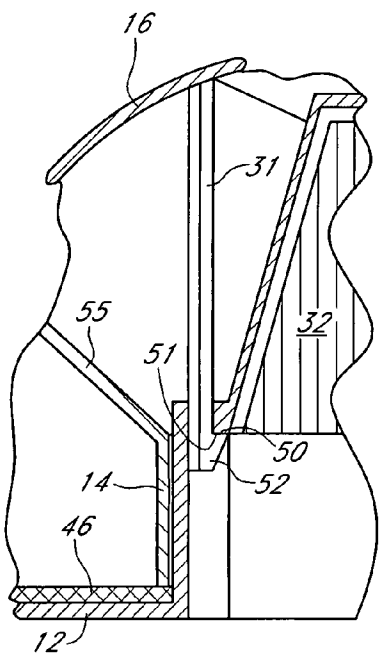
FIG. 6 is a detail view of the three major components of the invention illustrating a preferred structure of one a plurality of posts secured to a base component.

Finally, FIG. 6 depicts a detail section view to illustrate how the various components fit together. The base element 12 receives the tapered end 52 of the post 31 as shown. This tapered end 52 snaps in to place, held in place with the ratchet flange 50, which mates with a mating surface 51 on the base component. Thus, the intermediate, splash component is retained in place between the upper, dome-shaped component and the base component.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

What is claimed is:

1. A passive vent device for allowing air to flow from a vented enclosure comprising:

a) a base component having an outer flange surrounding a central opening;

b) a vertical wall surrounding said central opening and extending upwardly from said base component;

c) grill structure supported by said vertical wall adapted to permit air to flow through said central opening and said grill structure;

d) a dome-shaped top cover having a top surface and a radiused peripheral edge defining a continuous downwardly depending wall which terminates in a bottom edge suspended over said vertical wall so that said bottom edge is spaced from said flange and said downwardly depending wall is spaced outwardly from said vertical wall to define an air flow path upwardly through said central opening, outwardly through said grill structure, downwardly between said vertical wall and said downwardly depending wall and outwardly between said flange and said substantially circular bottom edge; and e) an angled diverter extending substantially around the periphery of said vertical wall and extending upwardly and outwardly from a vertical support defining a space between said vertical wall and said vertical support, said diverter further defining an outer edge which extends into and constricts but does not completely obstruct the air flow path between said vertical wall and said downwardly depending wall.

2. A passive vent device as defined in claim 1 wherein said diverter is mounted on said vertical wall.

3. A passive vent device as defined in claim 1 wherein said vertical wall is a five-sided wall.

4. A passive vent device as defined in claim 1 wherein said diverter is supported on an intermediate structure which surrounds said vertical wall.

5. A passive vent device as defined in claim 4 wherein said intermediate structure defines vertical sides positioned substantially parallel with said vertical wall.

6. A passive vent device as defined in claim 4 wherein said intermediate structure defines vertical sides positioned substantially parallel with and spaced from said vertical wall.

7. A passive vent device as defined in claim 6 wherein said top cover is secured to said base component with a plurality of posts which extend from said top cover through grooves in said vertical sides and mate with post receiving openings in said base component.

* * * * *

UNITED STATES PATENT AND TRADEMARK OFFICE

CERTIFICATE OF CORRECTION

PATENT NO. : 7,544,124 B2
APPLICATION NO. : 11/306276
DATED : June 9, 2009
INVENTOR(S) : Scott Polston It is certified that error appears in the above-identified patent and that said Letters Patent is hereby corrected as shown below:

Column 6,
Line 31 should read --said flange and said bottom edge;--

Signed and Sealed this

Eleventh Day of August, 2009

David J. Kappos

David J. Kappos
*Director of the United States Patent and Trademark Office*